US005095624A

United States Patent [19]

Ennis

[11] Patent Number: 5,095,624

[45] Date of Patent: Mar. 17, 1992

[54] LOCK SYSTEM FOR A FOLDING KNIFE

[76] Inventor: Raynold W. Ennis, 802 Cherry St., Grand Forks, N. Dak. 58201

[21] Appl. No.: 626,623

[22] Filed: Dec. 7, 1990

[51] Int. Cl.[5] ..... B26B 1/00; B26B 1/04

[52] U.S. Cl. ..... 30/161; 30/159

[58] Field of Search ..... 30/151, 153, 331, 159, 30/160, 161; 7/118

[56] References Cited

U.S. PATENT DOCUMENTS

| | | | |
|---|---|---|---|
| 462,141 | 10/1891 | Kruschke | 30/159 |
| 598,896 | 2/1898 | Berglund | 30/161 |
| 631,547 | 8/1899 | Miller . | |
| 717,958 | 1/1903 | White . | |
| 1,263,440 | 4/1918 | Lenardic . | |
| 2,808,646 | 10/1957 | Lohr, Jr. et al. | 30/159 |
| 3,568,315 | 3/1971 | Smith | 30/161 |
| 4,451,982 | 6/1984 | Collins | 30/161 |
| 4,536,959 | 8/1985 | Ross | 30/161 |
| 4,563,813 | 1/1986 | Fortenberry | 30/161 |
| 4,570,341 | 2/1986 | Konneker | 30/161 |

*Primary Examiner*—Frank T. Yost
*Assistant Examiner*—Paul M. Heyrana, Sr.
*Attorney, Agent, or Firm*—Zarley, McKee, Thomte, Voorhees & Sease

[57] ABSTRACT

A folding knife including a lock for positively maintaining the knife blade in a locked condition comprising an upstanding locking pin which is integrally formed with the knife blade and which is received by an opening in a pivotal toggle mounted on the upper end of the blade handle. The toggle is yieldably maintained in its locked condition by a coil spring mounted in an elongated bore formed in the knife handle.

3 Claims, 2 Drawing Sheets

LOCK SYSTEM FOR A FOLDING KNIFE

BACKGROUND OF THE INVENTION

This invention relates to a folding knife and more particularly to a lock system for a folding knife.

Folding knives normally include some apparatus for maintaining the knife blade in its open position. The vast majority of the prior art folding knives employ a rocker type action on a locking bar which requires the user to push down on the back end of the lock with one hand while closing the blade with the other. Applicant believes that the prior art folding knives have many disadvantages. One disadvantage of the prior art blades is that the person using the knife must place a portion of his/her finger or hand beneath the sharp cutting edge to unlock the blade. A further disadvantage is that the blade can only be folded to its closed position by means of a two-hand operation. Yet another disadvantage of the prior art folding knives is that the lock pin of the knife is inadequately supported. Yet another disadvantage of the prior art knives is that they employ leaf type springs which are prone to more frequent failure than coil springs. Still another disadvantage of the prior art is that the locking system may fail due to wear on the corner of the lock notch or the lock bar. Still another disadvantage of the prior art knives is that they utilize an insufficient distance between the lock notch and the blade pivot thereby causing cracks or failures of the lock or blade.

It is therefore a principal object of the invention to provide an improved locking system for a folding knife.

Still another object of the invention is to provide a lock system for a folding knife wherein the blade may be unlocked without utilizing both hands.

Still another object of the invention is to provide a lock system for a folding knife which is safe to use.

Still another object of the invention is to provide a lock system for a folding knife utilizing a coil spring which yieldably maintains the locking bar in its locked position.

Still another object of the invention is to provide a lock system for a knife blade which is easy and convenient to use.

These and other objects of the present invention will be apparent to those skilled in the art.

SUMMARY OF THE INVENTION

A lock system for a folding knife is described wherein the knife is provided with an upstanding integral locking pin which is received in an opening in one end of a locking toggle as the blade is folded to its open or operative condition. A plunger is positioned in the knife and engages one end of the toggle bar to maintain the toggle bar in engagement with the locking pin so that the knife blade will not inadvertently close. The toggle may be disengaged from the knife blade and the knife blade folded to its closed position in a one hand operation.

DESCRIPTION OF THE PREFERRED EMBODIMENT

Figure 1:
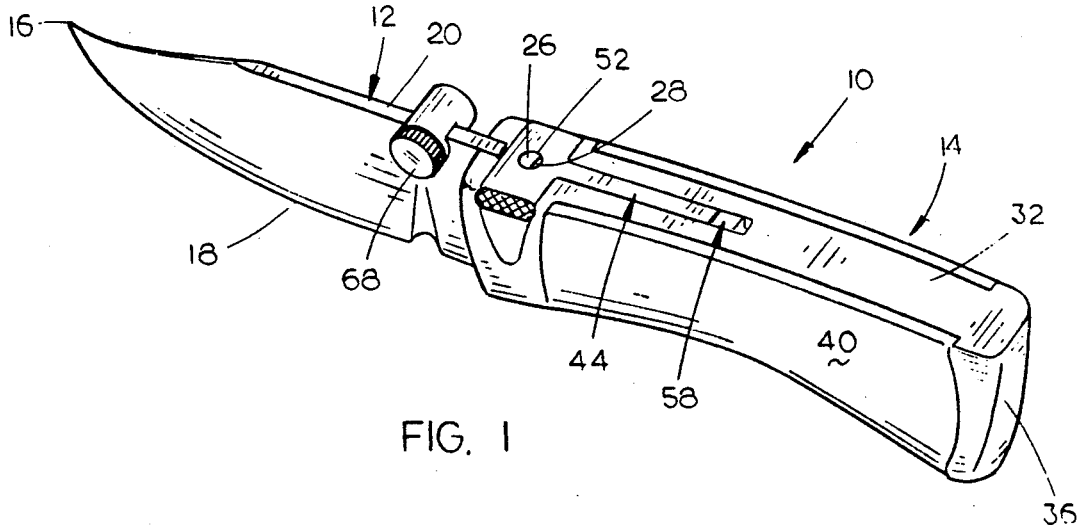
FIG. 1 is a perspective view of the knife of this invention in its open position.
Figure 2:
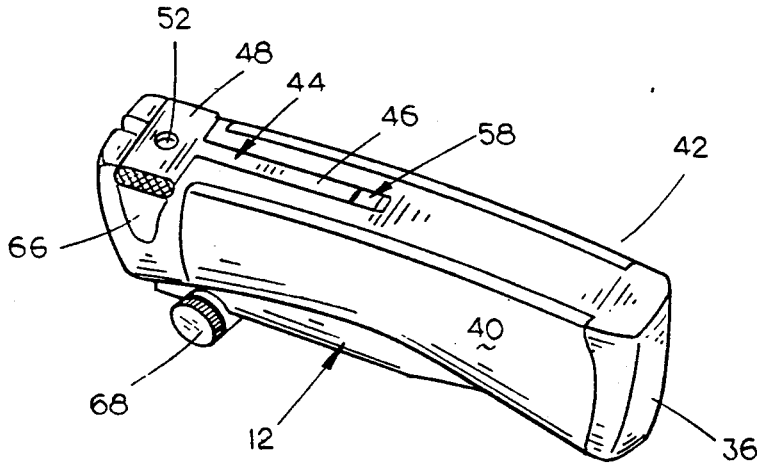
FIG. 2 is a perspective view illustrating the knife in a closed position.
Figure 3:
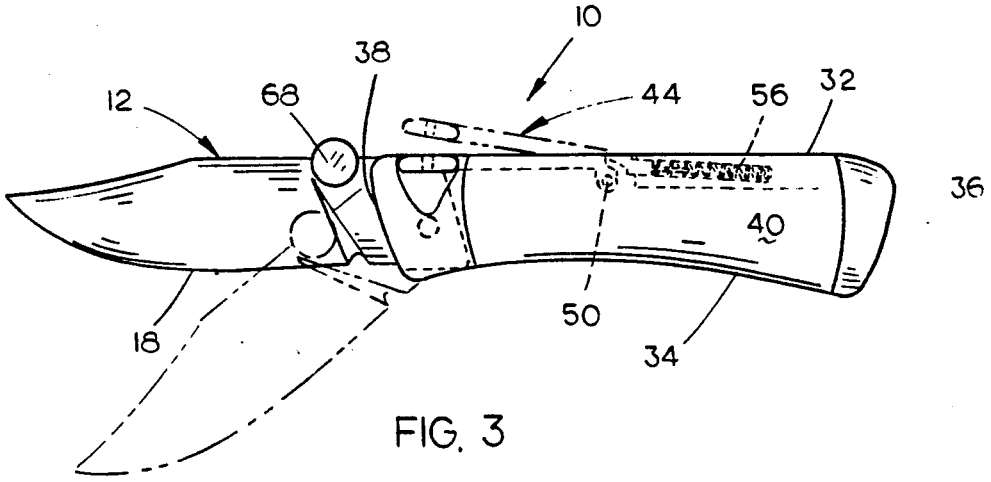
FIG. 3 is a side elevational view illustrating the knife blade in its open position with the broken lines illustrating positions to which the components may be moved.

The numeral 10 refers generally to the folding knife of this invention and which generally includes a blade 12 and handle 14. As seen in FIGS. 1 and 2, the blade 12 may be selectively pivotally moved from its open position as illustrated in FIG. 1 to the position illustrated in FIG. 2.

Figure 4:
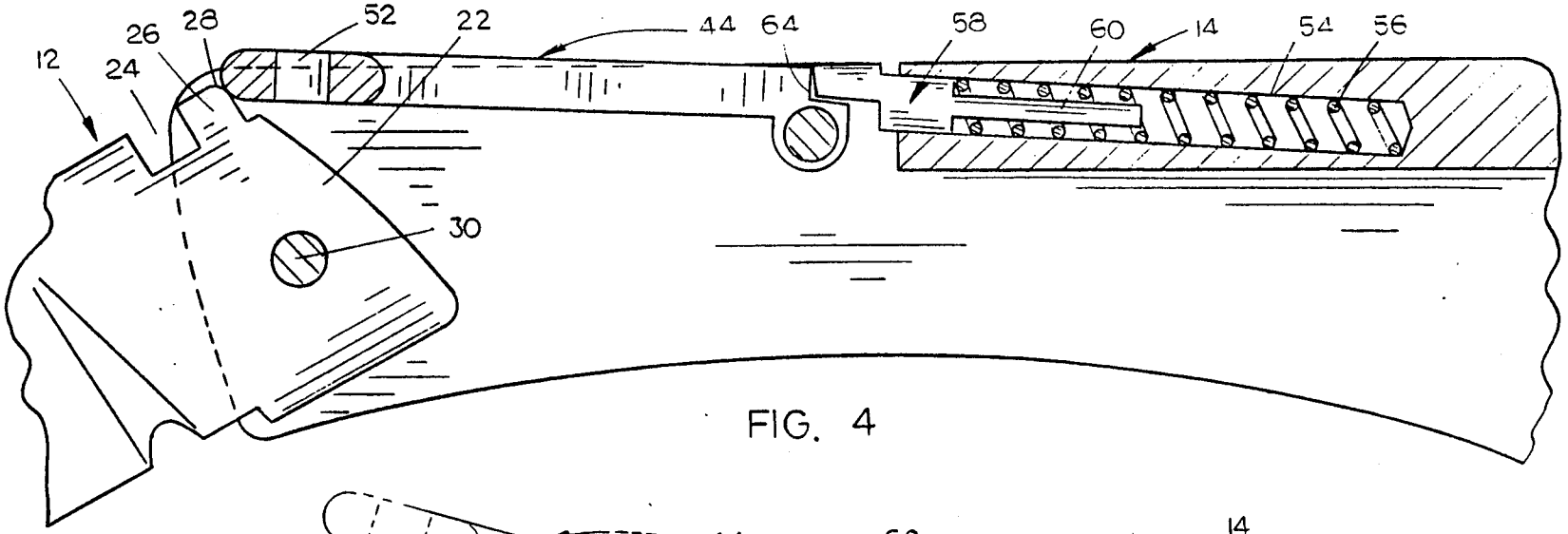
FIG. 4 is an enlarged sectional view illustrating the manner in which the knife blade is pivoted to its open position.

Blade 12 includes a tip end 16, a sharpened lower edge 18, an upper edge 20, and a shank portion 22. Shank portion 22 is provided with a notch 24 formed in its upward rearward end as illustrated in FIG. 4. Locking pin 26 is positioned in notch 24 and includes a cam surface 28 at its upper rearward end. Blade 12 is pivotally secured to handle 14 by means of pin 30.

Handle 14 includes an upper end 32, lower end 34, rearward end 36, forward end 38, and opposite sides 40 and 42. The lower end of handle 14 is provided with an elongated slot (not shown) which receives the sharpened portion of the blade 12 as illustrated in FIG. 2 when the blade is in its closed position.

The numeral 44 refers to a T-shaped toggle including an elongated arm 46 and flat head portion 48. Toggle 44 is pivotally mounted at its rearward end to handle 14 by means of pin 50. Head portion 48 is provided with an opening 52 formed therein which is adapted to receive the locking pin 26 when the blade 12 is in its open condition as illustrated in FIGS. 1 and 5.

Handle 14 is provided with an elongated bore 54 formed therein in which coil spring 56 is mounted. The numeral 58 refers to a plunger having a rearward end 60 and a forward end 62. As seen in FIG. 5, coil spring 56 embraces the rearward end 60 of plunger 58. As also seen in the drawings, the forward end 62 of plunger 58 is adapted to engage the shoulder 64 of toggle 44 to maintain toggle 44 in its locked position which is illustrated by solid lines in FIG. 5. However, if it is desired to raise toggle 44 to enable the knife blade to be moved from its open position to its closed position, toggle 44 may be pivotally moved upwardly as illustrated by broken lines in FIG. 5 to disengage pin 26 from opening 52. Handle 14 is provided with a pair of recesses 64 at its opposite sides located below the outer ends of the head portion 48 to enable a person to grasp the outer ends of the head portion 48 to manually pivotally move head portion 48 upwardly to permit the disengagement of the pin 26 from the opening 52.

In operation, assuming that the knife is in its closed position as illustrated in FIG. 2, the blade 12 may be moved to the position of FIG. 1 by simply grasping the blade of the member 68 to pivotally move the blade from the position of FIG. 2 to the position of FIG. 1. As the blade 12 reaches the position as illustrated in FIG. 4, the cam surface 28 engages the forward end of head portion 48 thereby causing head portion 48 to move upwardly against the resiliency of the spring 56 so that the upper end of pin 26 passes beneath head portion 48 until locking pin 26 registers with opening 52 at which time toggle 44 moves downwardly to lock pin 26 in the opening 52 as illustrated in FIG. 5.

Figure 5:
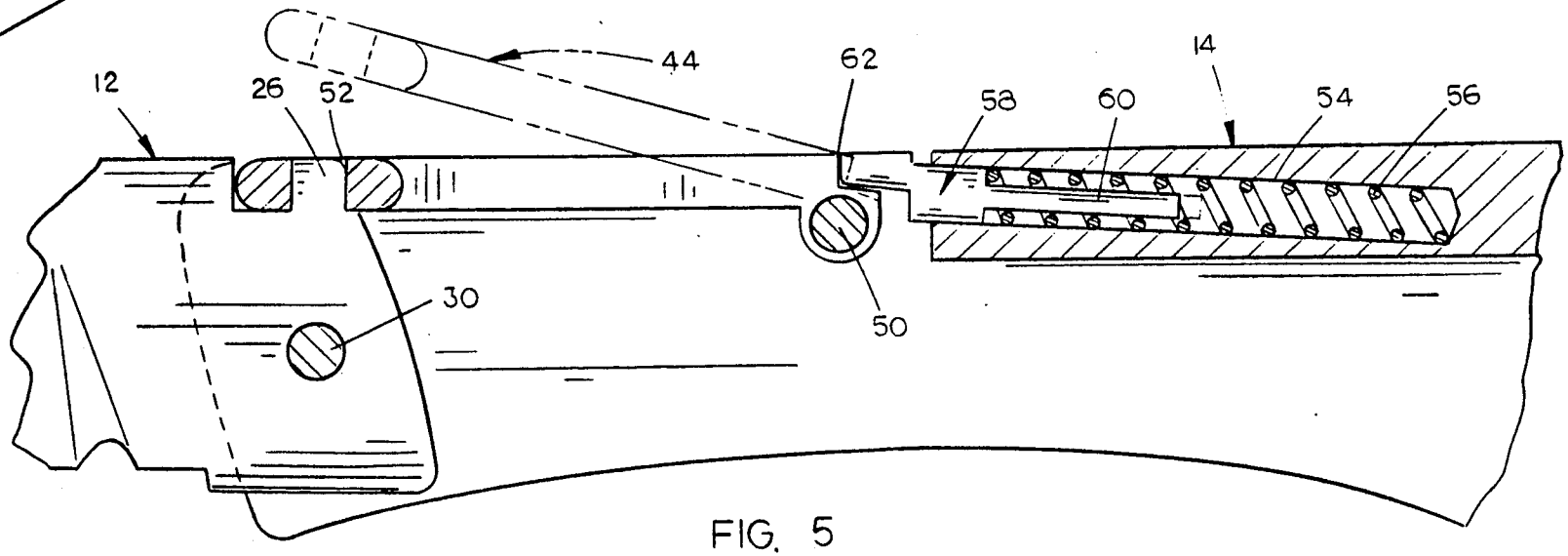
FIG. 5 is a view similar to FIG. 4 except that the blade has been moved to its open position.

When the blade 12 is in the opening position as illustrated in FIGS. 1 and 5, the resiliency of the coil spring 56 maintains locking pin 26 in engagement with the opening 52 of toggle 44 so that the blade 12 is positively maintained in its locked open position. When it is desired to move the blade from its open position to its closed position, the user needs simply grasp one or both ends of the head portion 48 and move the same upwardly to the position illustrated by broken lines in FIG. 5 so that head portion 48 disengages from locking pin 26. The blade 12 may then be pivoted to the closed position of FIG. 2 by simply pressing or placing the upper edge 20 of blade 12 against a surface or a portion of the user's body to cause the blade to be pivoted to the closed position.

Thus it can be seen that a novel locking apparatus has been provided which positively maintains the knife blade in its open position without fear that the blade will pivot to its closed position during the use thereof. The lock system described herein permits the blade to be moved from its open to closed position through the use of a single hand rather than two hands as required by the prior art. The locking system of this invention is extremely strong and durable due to the configuration of the lock pin and the opening 52 in which it is received. The fact that the pin 26 is integral with the blade ensures that the same will not easily fail. The knife of this invention is extremely safe since it is not necessary to place any portion of the hand or fingers beneath the sharpened edge of the blade. Further, the fact that the toggle is seated in a notch in the frame gives support to the pivot pin. Thus it can be seen that the invention accomplishes at least all of its stated objectives.

I claim:

1. A lock system for a folding knife, comprising, a handle having rearward and forward ends, an upper end, a lower end, and spaced apart sides, a blade having a tip end and a shank end, a sharpened lower edge extending from said tip end towards said shank end, and an upper edge, said blade being pivotally secured at its shank end, to said handle and being pivotally movable between open and closed positions, said handle having a slot formed therein extending into its lower end which receives said sharpened lower edge of said blade when said blade is in its closed position, said handle having a slot formed in its forward end which pivotally receives the shank end of said blade, the rearward upper edge of said shank end of said blade having a notch formed therein, said blade having an upstanding, locking pin positioned in said notch, said handle having a notch formed in its upper end adjacent its forward end, an elongated toggle pivotally secured at one end to said handle intermediate the ends thereof and extending towards said forward end of said handle, said toggle being movable between first and second positions, said toggle comprising an elongated arm having rearward and forward ends, and a toggle head which is positioned in said notch in the upper forward end of said handle when said toggle is in its said first position, said toggle head having an opening formed therein which receives said locking pin when said blade is in its open position and said toggle is in its said first position, to lock said blade in its said open positions, said handle having a bore formed therein extending rearwardly from immediately adjacent the rearward end of said elongated arm, a plunger member slidably mounted within said bore, having forward and rearward ends, the forward end of said plunger in contact with a portion of the rearward end of said elongated arm, and a coil spring means in said bore which is in operative engagement with the rearward end of said plunger member which yieldably biases said plunger member forwardly against said elongated arm to yieldably maintain said toggle in its said first position.

2. The apparatus of claim 1 wherein said toggle head has oppositely disposed side edges and wherein said handle has a recessed area formed in each of its sides adjacent the forward end thereof for partially exposing the side edges of said toggle head.

3. The apparatus of claim 2 wherein said toggle head has a width substantially equal to the width of said handle.

* * * * *